US006450492B1

(12) United States Patent
Coombs et al.

(10) Patent No.: US 6,450,492 B1
(45) Date of Patent: Sep. 17, 2002

(54) METHOD AND APPARATUS FOR SET BINDING, STAPLING AND STACKING

(75) Inventors: Peter M. Coombs, Tustin; James R. Seay, Lake Forest, both of CA (US)

(73) Assignee: Gradco Japan, Tokyo (JP)

( * ) Notice: Subject to any disclaimer, the term of this patent is extended or adjusted under 35 U.S.C. 154(b) by 0 days.

(21) Appl. No.: 10/017,824

(22) Filed: Nov. 29, 2001

Related U.S. Application Data

(62) Division of application No. 09/078,202, filed on May 14, 1998, now Pat. No. 6,330,999.

(51) Int. Cl.[7] ..... B42B 9/00

(52) U.S. Cl. ..... 270/58.08; 270/58.07; 412/18; 412/20

(58) Field of Search ..... 270/58.08, 58.07; 412/18, 19, 20, 8, 37

(56) References Cited

U.S. PATENT DOCUMENTS

| | | | | |
|---|---|---|---|---|
| 3,531,358 A | | 9/1970 | Rost et al. | |
| 3,926,712 A | | 12/1975 | Weltzer et al. | |
| 4,129,471 A | | 12/1978 | Rome | |
| 4,149,289 A | | 4/1979 | Sahlin | |
| 4,343,673 A | | 8/1982 | Smith, Jr. et al. | |
| 4,441,950 A | | 4/1984 | Lolli | |
| 4,552,497 A | * | 11/1985 | Kockler et al. | 270/37 |
| 4,586,640 A | * | 5/1986 | Smith | 227/14 |
| 4,611,741 A | | 9/1986 | Wilson | |
| 4,797,048 A | | 1/1989 | Doery | |
| 5,052,873 A | | 10/1991 | Parker et al. | |
| 5,172,179 A | * | 12/1992 | Tani et al. | 100/26 |
| 5,174,556 A | * | 12/1992 | Taylor et al. | 270/1.02 |
| 5,355,207 A | | 10/1994 | Yano et al. | |
| 5,395,466 A | | 3/1995 | Tukagoshi et al. | |
| 6,000,894 A | * | 12/1999 | Suzuki et al. | 270/32 |

* cited by examiner

*Primary Examiner*—Christopher P. Ellis
*Assistant Examiner*—Patrick Mackey

(57) ABSTRACT

Apparatus is provided for receiving and assembling sheets in a binding station at which thermal binding strips are automatically supplied to the side edges of the assembled sets, the sheet receiving trays at the binding station are laterally moved apart to allow a set of assembled bound or unbound sheets to gravitate to a stapling station at which an assembled set of sheets may be stapled together, and the trays forming the stapling station are moved laterally apart to allow the stapled set to gravitate to a stacker tray which is allowed to move downwardly as progressive sets are deposited on the stacker tray and the stacker tray is moved upwardly to a set receiving position following removal of finished sets.

18 Claims, 7 Drawing Sheets

FIG. 2.
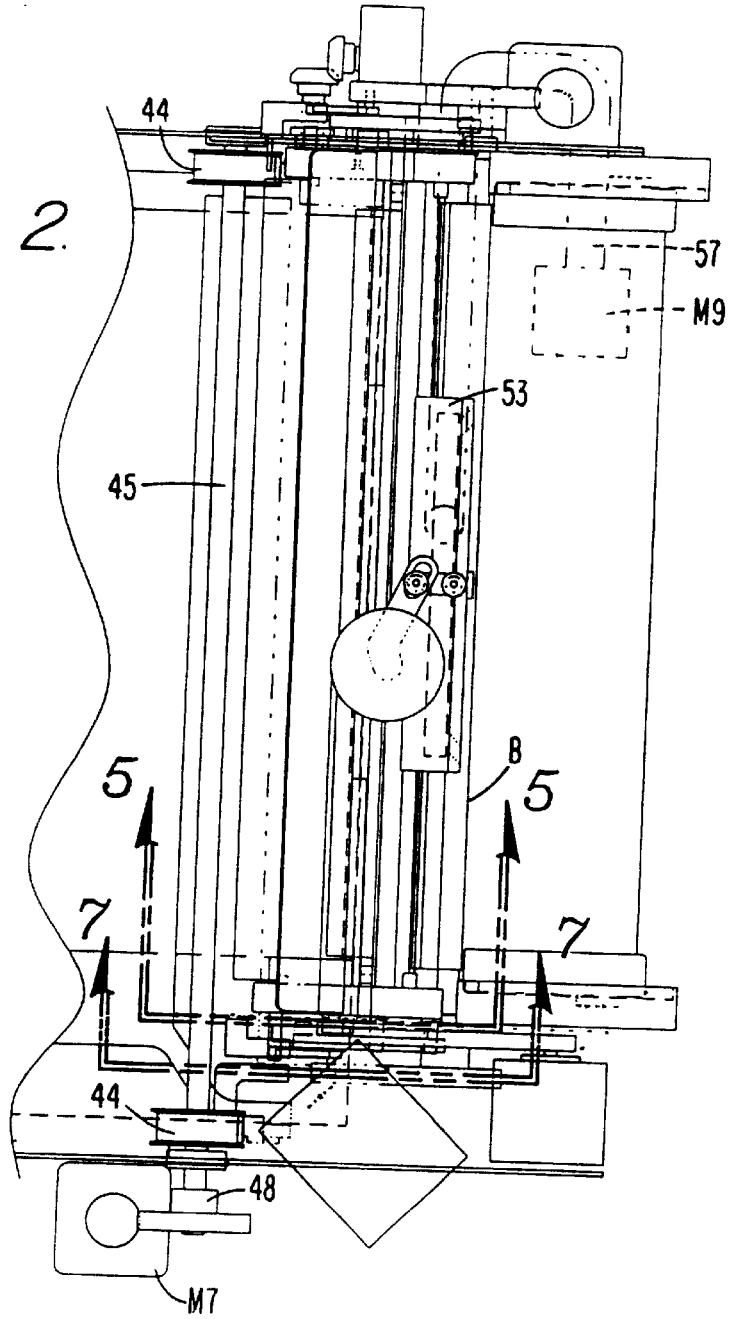
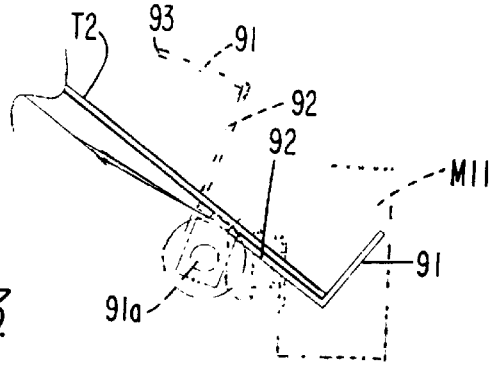
FIG. 13.

FIG. 7.
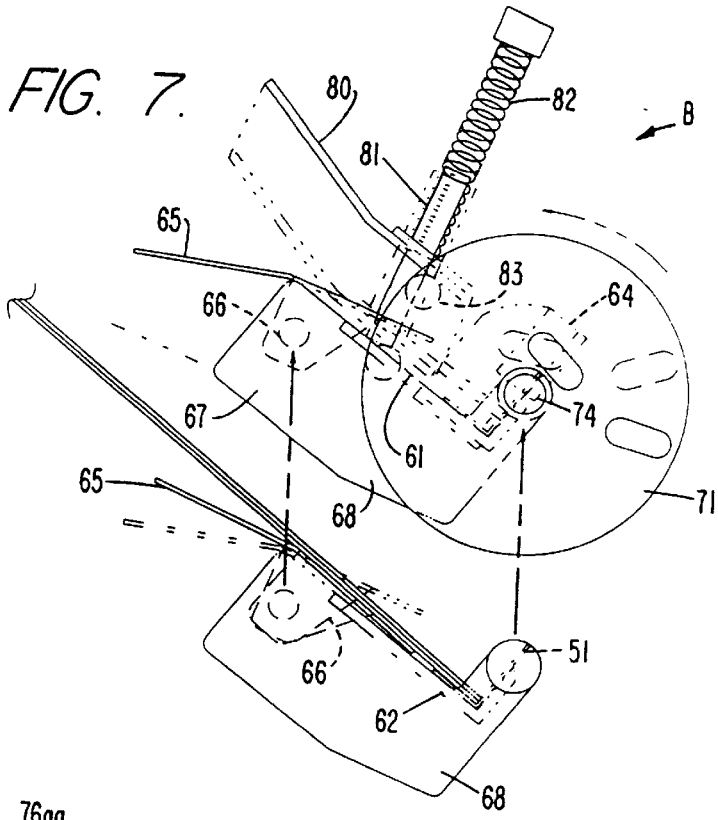
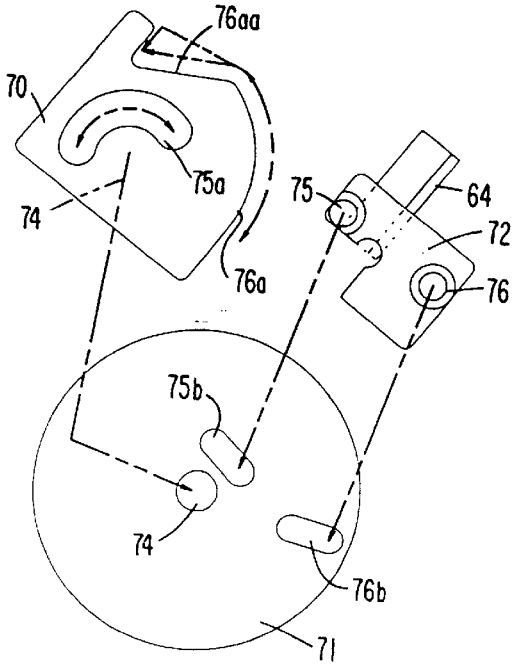
FIG. 8a.
FIG. 8.
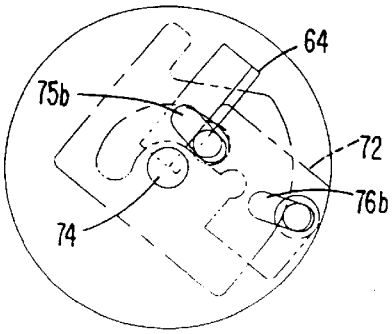

METHOD AND APPARATUS FOR SET BINDING, STAPLING AND STACKING

RELATED APPLICATIONS

The present application is a Divisional Application based upon U.S. patent application Ser. No. 09/078,202, filed on May 14, 1998, entitled Set Binding, Stapling and Stacking Apparatus, and assigned to the same assignee as the present application, now U.S. Pat. No. 6,330,999.

BACKGROUND OF THE INVENTION

In the prior art devices are known which are frequently called post processing devices and which are constructed to receive printed sheets from a printer or copier, assemble the sheets into a set, finish or staple the sets, and then discharge the sets from the finishing station to a stacker which automatically stacks the finished sets.

Such devices typically involve a fairly large footprint to accommodate the floor space occupied by the apparatus for receiving the sheets from the sheet producing machine as well as the stacking apparatus.

Examples of such prior art are shown in U.S. Pat. No. 5,449,157 dated Sep. 12, 1995 and U.S. Pat. No. 5,639,079 dated Jun. 17, 1997.

Also, it is known in the prior art to apply various kinds of binding strips or adhesive material to the edge of assembled sets of sheets during the printing processes, wherein sets of sheets are collected, thermally bound and then ejected from the binding station to a suitable receiver.

An example of the prior art related to such binding apparatus is seen in U.S. Pat. No. 3,531,358 dated Sep. 29, 1970.

Desktop thermal binding devices are also extant, as seen in U.S. Pat. No. 3,518,143 dated Jun. 30, 1970 in which a set of sheets can be manually assembled and placed into an apparatus for edge binding with a thermo-plastic foil applied to the set of sheets with the application of manually operated pressure applying means.

Also, there is extant, a desktop or manually operated thermal binder which has a heater assembly into which an L shaped adhesive binding strip may be manually inserted, a set of sheets manually placed into the corner of the L shaped binding strip and the long side of the L shaped strip, then folded against the off side of the set during the application of heat and manually operated pressure application.

An example of a disclosure of a kind of shutter mechanism in which a pair of horizontally opposed support plates are moved laterally to allow a set of sheets supported thereon to drop downwardly is found in U.S. Pat. No. 5,470,050 dated Nov. 28, 1995.

Numerous examples of apparatus for receiving sets of sheets, jogging the sheets into a neat stack and moving the stack into a stapler can be found, including, for example, in U.S. Pat. No. 5,713,566 dated Feb. 3, 1998, co-owned herewith.

SUMMARY OF THE INVENTION

With the foregoing in mind, the present invention has, as an object, the provision of a relatively compact apparatus which may be applied to the sheet output from a sheet copying or printing machine to receive from the copying or printing machine successive sheets which are accumulated or assembled in a tray for binding or a tray for stapling, in which the bound or stapled sets are downwardly discharged from the respective assembling stations, which are positioned one above the other and above a stacker, so that the overall apparatus occupies a minimum of horizontal footprint.

More particularly, the apparatus is contemplated to automatically apply binding strips in a binding station at which heat and pressure are automatically applied to the binding strips to adhesively secure the sheets in an integrated set, and wherein, in the event that binding is not desired. The accumulated set may be discharged vertically to a second treating station for stapling or,if desired, for punching, and still further, the finally treated set is discharged vertically to a vertically adjustable stacker tray adapted to receive the desired number of sets.

Additionally, at the second set treating station, if desired, the stapled sets or the bound sets may be laterally offset to facilitate set separation from the stacker tray.

It is contemplated that the binding and stapling stations may be disposed one over the other, but in the specific form herein shown and described, the binding station is above the stapling station.

Still further, it is contemplated that a finishing machine of small size may be provided which consists of only one finishing station, either a binding or a stapling station, by elimination of one of the stations and providing for stacking of the sets so finished, by opening the receiving and assembling tray parts at said one station and allowing downward movement of the set to the stacker.

Other objects and advantages of the invention will be hereinafter described or will become apparent to those skilled in the art.

BRIEF DESCRIPTION OF THE DRAWINGS

FIG. 2 is a horizontal section substantially on the line 2—2 of FIG. 1;

FIG. 7 is a fragmentary section, on the line 7—7 of FIG. 2 showing sheet guide means and clamping means for positioning and clamping sheets on a bonding strip in the heater;

FIG. 8 is a detail view showing means for moving the top heater to apply pressure to a set of sheets;

FIG. 8*a* is an exploded detail of the components of FIG. 8;

FIG. 13 shows means for supporting and dropping a set of sheets stapled by the automatic stapler at the stapling station.

DESCRIPTION OF THE PREFERRED EMBODIMENT

Figure 1:
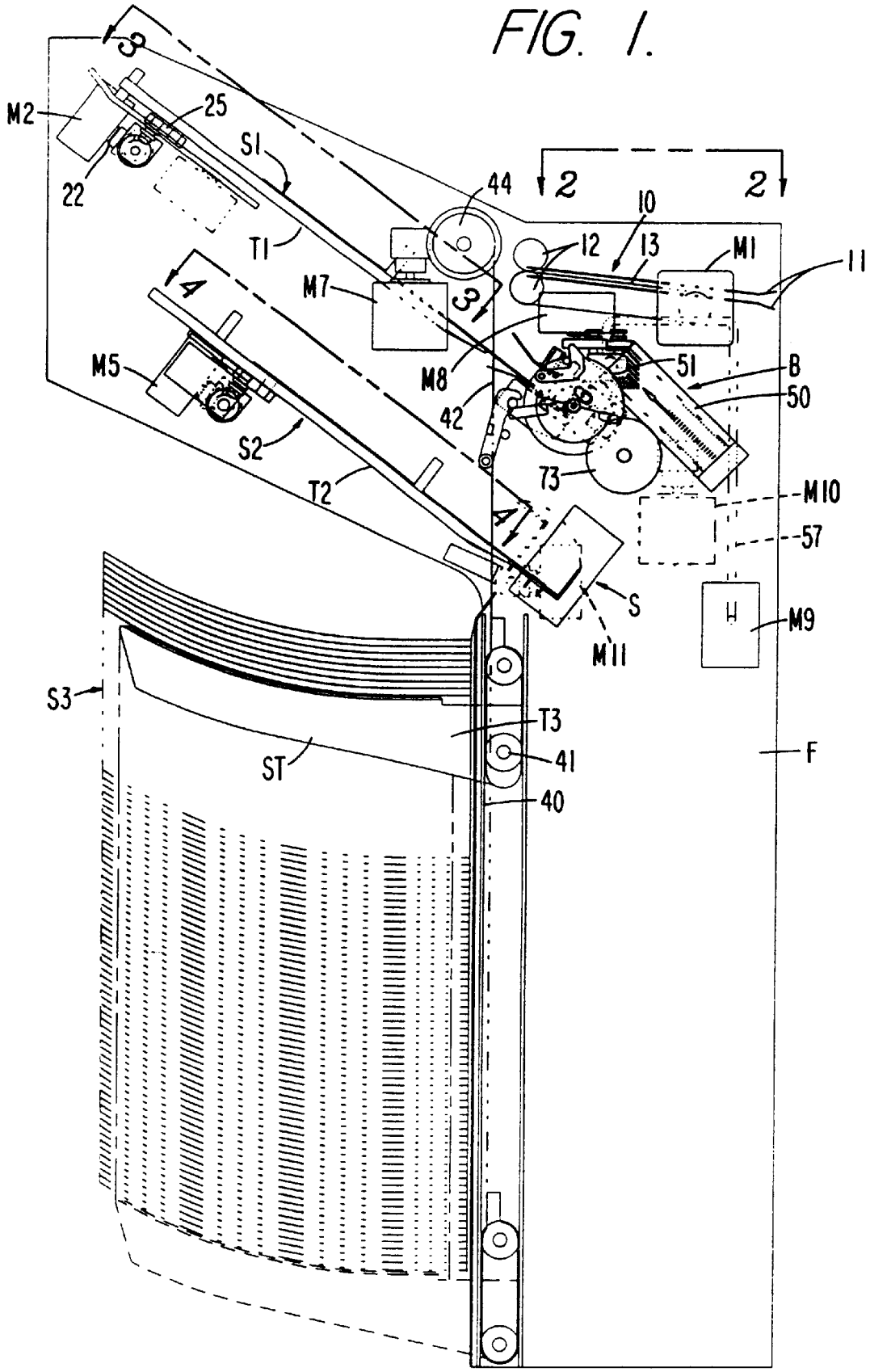
FIG. 1 is a vertical section through a set binding, stapling and stacking apparatus in accordance with the invention, with covers and certain frame parts removed.

Referring first to FIG. 1, the apparatus includes a suitable frame F supporting a first sheet set assembling and finishing station S1 and a second sheet or set assembly and finishing station S2 located above a stacker station assembly S3.

The finishing station S1, as herein shown, includes an automatic thermal strip binding means B and the second finishing station S2 includes a stapling means S.

The apparatus includes, also, sheet infeed means 10 for feeding sheets received from a source, say a copying or printing machine into an upwardly inclined tray assembly T1 in which sets of sheets received in the tray assembly, as will be later described, may be received and positioned downwardly on the tray assembly for binding by the binding means B, if binding is desired, following which, due to the construction of tray T1, it may be opened horizontally allowing the bound or unbound set to be dropped downwardly to the station S2, which includes a tray assembly T2 in which the set of sheets may be stapled together if stapling is needed or desired and the sheets have not been bound together in a set at the binding means B, so that stapling would not normally be desired.

It is within the purview of the invention that in some installations feeding means, not shown, may be provided in association with infeed means 10 to selectively feed sheets directly to each of finishing stations, selectively, say, to station S2, if binding is not selected for finishing the set.

Thereafter the tray assembly T2, due to its construction, is adapted to open horizontally so as to discharge the set therefrom downwardly to a stacker station ST at which a stacker tray T3 is adapted to be normally held in an upper position for receiving sets discharged onto the latter from the station S2.

It will be noted that in such a construction, the horizontal space or footprint occupied by the entire apparatus can be relatively small due to the fact that the tray assemblies T1 and T2 of the respective finishing stations S1 and S2 are located one above the other and they are respectively adapted to discharge sets downwardly to the stacker station ST located below the finishing stations, and further the only additional horizontal space required is to accommodate sheet feeding, binding and stapling.

The sheet infeed 10, as here shown, is suitably constructed so as to receive sheets from a source, such as a host copier or printer, if such infeed is not provided by the host, and includes, for illustrative purposes, a drive motor M1, sheet guides 11 and a set of infeed rollers 12 driven by a belt 13. Various infeed structures may be employed. In the form shown, the feeding means 10 feeds printed sheets into the upwardly extended tray T1, and the sheets so fed will normally move by gravity or means may be provided, as described below, to cause the set to move downwardly to the binding means B.

Figure 3:
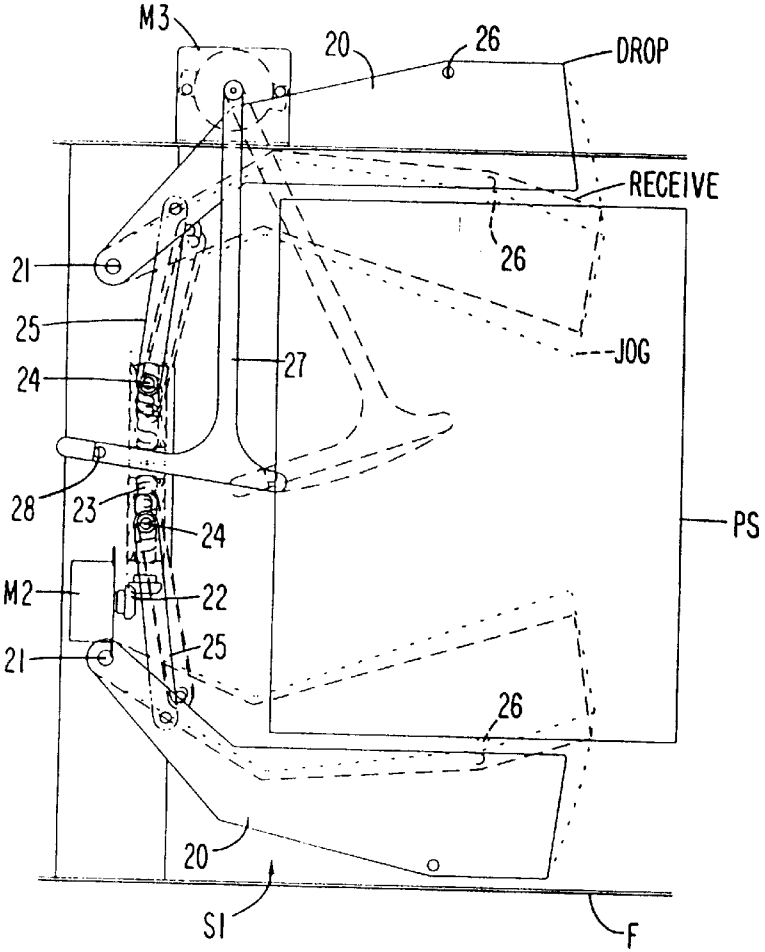
FIG. 3 is a horizontal section on the line 3—3 of FIG. 1 illustrating the tray parts in positions for receiving sheets, jogging and dropping sheets or sets in the first station to the second station.

Referring to FIG. 3, the preferred structure of the tray assembly T1 includes a pair of tray members 20 each pivotally mounted at 21 to form in certain positions of the tray members companion parts of a sheet support. A stepper motor M2 and associated gearing 22 are adapted to drive a rotary spiral cam 23 in opposite directions. The cam has opposite spiral cam tracks at its opposite ends so that cam followers 24 engaged with the cam and links 25 connected to tray parts 20 and the followers 24 cause the tray parts 20 to pivot to the several position shown in full and broken lines, as indicated by the arrows, in opposite horizontal directions.

Tray parts 20 are adapted to be moved between three positions designated as a "DROP" position shown in full lines, a "RECEIVE" position shown in long broken lines and a "JOG" position shown in short broken lines. In the "RECEIVE" position of the tray parts, a paper sheet PS is adapted to be deposited on the tray parts when fed from the infeed means 10, and as successive sheets are deposited one on the other upon the tray parts, the stepper motor M2 is operated to move the tray parts, at the sheet receiving ends thereof, towards and away from the "JOG" position, so that jogging pins 26 on these parts contact the side edges of the sheets to align the sheets along these edges. Also, a jogging arm 27 supported on the shaft of a stepper motor M3 and having a jogging pin 28 is adapted to be pivoted from the full line position of FIG. 3 to the broken line position so that the pin 28 will engage the leading edge, as viewed in the direction of infeed, of the sheets supported on the tray parts to move the jogged sheets in a direction down the inclined tray T1, as seen in FIG. 3, into the thermal binding mechanism later to be described.

Also, as seen in FIG. 3 it will be recognized that when the tray parts 20 are moved to the outermost "DROP" position, a set of paper sheets or individual sheets will be allowed to drop vertically downwardly between the tray parts.

Figure 4:
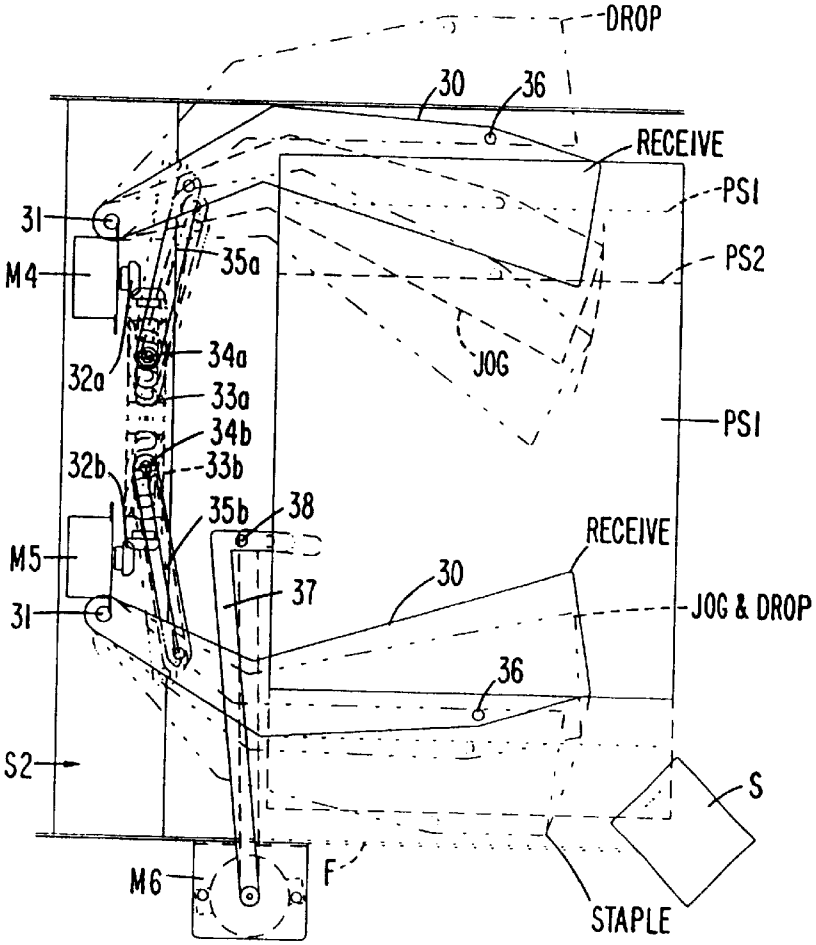
FIG. 4 is a horizontal section on the line 4—4 of FIG. 1 illustrating the tray parts in positions for receiving sheets dropped from the first station, jogging, stapling, offsetting and dropping sets to the stacker station.

This station S2, in this case the stapling station, also includes a pair of elongated tray parts 30 respectively pivoted at 31 and adapted to be pivotally moved between the several full and broken line position shown in FIG. 4 by first and second stepper motors M4 and M5 through gearing **32*a* and 32*b* adapted to drive individual spiral cams 33*a* and 33*b* in opposite directions, so that cam driven followers 34*a* and 34*b* connected to the respective tray parts by links 35*a* and 35*b* are individually moved to greater or lesser pivotal extent to perform various functions at station S2** as the tray parts are moved, as indicated by the arrows.

As indicated at PS, the paper sheet shown in full lines in FIG. 3 is also shown in full lines in FIG. 4 as having been received when the tray parts 30 are in the full line or "RECEIVE" position.

The tray parts 30 have jogging pins 36 movable into contact with the opposing edges of the sheets or sheet sets in response to, in the case of station S2, differential movements of the tray parts 30 resulting from differentials in the drives to the pivoted tray parts of motors M4 and M5 and the individually operable cam sections **33*a* and 33*b*, as shown by the various full line, broken lines between the short broken line paper locations PS1 or "JOG" position at which sheets or sheet sets may be jogged, and the long broken line position of PS2** in which the corner of the set of sheets is engaged in the throat of the usual stapler S at one corner of the set when the tray parts are in the "STAPLE" position.

To assure registration of the outer edges of the set, a stepper motor M6 drives a lever 37 between the 2 positions shown in full and broken lines, so that a pin 38 on the lever contacts the edge of the sheet set to align that edge and also position the set of sheets at its corner in the stapler S.

Thereafter, the sheets in a stapled set may be displaced horizontally by movement of the upper part 30, as viewed in FIG. 4, of the tray to the "DROP" position and moving the lower part of the tray, as viewed in FIG. 4, to the "JOG" and "DROP" position, so that the set of sheets stapled together in a neat set will be dropped through the tray parts 30 from the tray assembly T2 to the stacker station S3 onto the stacker tray ST.

In the event that the apparatus is being employed to thermally bind sets in station S1, then it may be preferred to maintain the parts of tray T2 in the "DROP" positions described above to enable the bound sets to simply pass through the stapling station S2.

As will be best recognized upon reference to FIG. 1 and FIG. 2, the stacker station S3 is supported for vertical movement on guide rails and rolls 40 and 41 by typical bands or cables 42 wound on spools 44 mounted on cross shaft 45 driven by a stepper motor M7 and suitable gearing 48, as is well known in the art of stacking sets of sheets, wherein the motor M7 (under control of the usual sensor, not shown) will maintain the stacker tray ST in an upper position while allowing the tray ST to move progressively downwardly as additional sets are added to the stack, as shown in FIG. 1.

At the respective finishing stations S1 and S2, there is a movable support for the trailing edge of the sets of sheets, viewed in the direction of infeed, which normally is in a position to support the trailing edge in a position for binding or stapling, but which shelf is caused to move from beneath the trailing edge of the set when the portions of the respective trays T1 and T2 are moved laterally to drop the set of sheets supported thereon.

At the binder B, the shelf, as will be hereinafter described, is incorporated in the thermal binding device, and is moved upon completion of a binding operation, and at the stapling station the shelf is moved following the application of a staple and positioning of the set to the "DROP" position.

Figure 5:
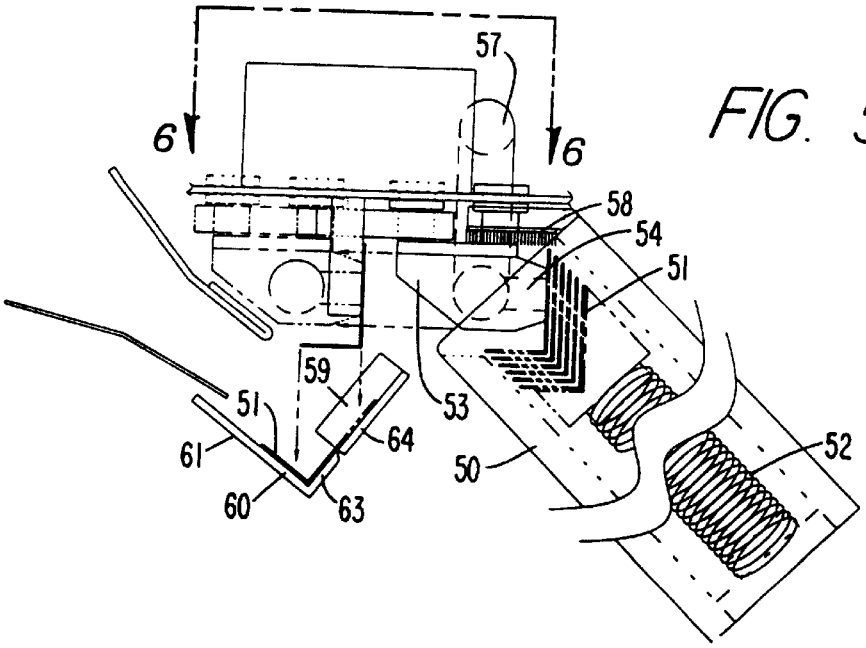
FIG. 5 is a fragmentary view on the line 5—5 of FIG. 2, showing the bonding strip feeding means for depositing a strip in the heater.
Figure 6:
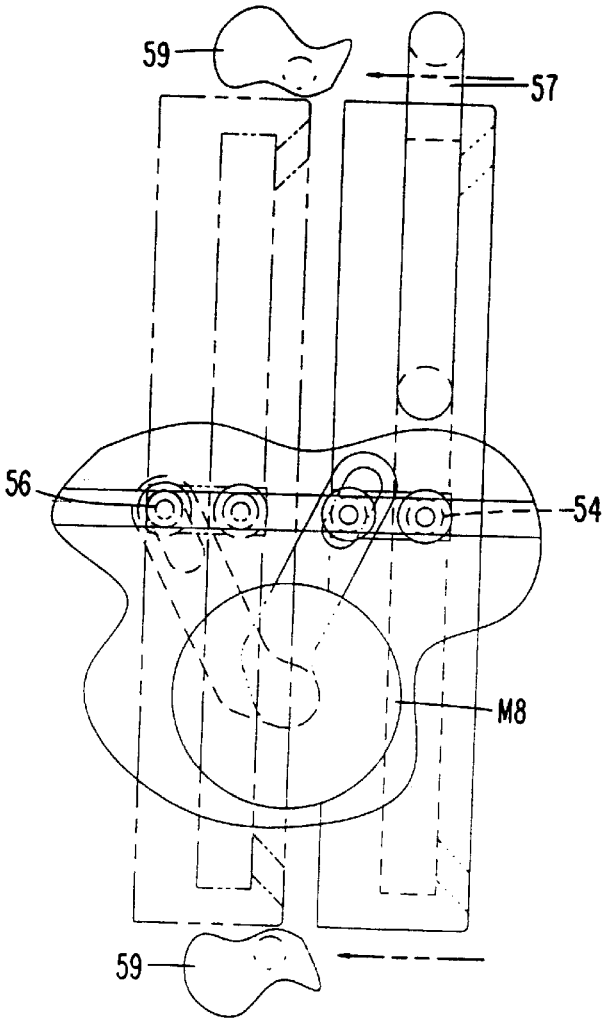
FIG. 6 is a top plan of the structure of FIG. 5.

Referring to FIG. 5 it will be seen that the binding means includes a lower heating element, to be later described, which constitutes, together with other structures, the shelf for the trailing edge of the set and the lower heater is allowed to move downwardly from beneath the trailing edge of the set following completion of the binding operation.

Means are provided at binder B to successively provide binding strips to the lower heater element, clamp the trailing edges of successive sheets forming the set, move an upper heater element into engagement with a portion of the binding strip and deform the binding strip toward the lower heater element. Following completion of a bind, the bound set is released for downward movement by downward swinging movement of the lower heater-shelf when the tray parts of tray T1 are moved to the "DROP" position.

Referring briefly to FIG. 13, a shelf member, as will be later described, is also pivoted to swing downwardly following setting of a staple and return of the stapled set to the "DROP" position of the tray parts of tray T2.

As best seen in FIGS. 1, 2, 5 and 6, the thermal binding means B includes a cartridge 50 for receiving a stack of binding strips 51 biased by a spring 52 upwardly towards an open upper end of the cartridge. At this open upper end, the strips which, in the illustrated embodiment, are right angular in shape, are engaged by transfer means, including a horizontally extended vacuum tube 53 having suction ports for attraction of an upwardly extended side of the uppermost strip. Tube 53 is mounted for horizontal movement between a first position shown in full lines in FIGS. 2, 5 and 6, to a second position shown in broken lines in FIGS. 5 and 6 by suitable guides 54. Actuator means include a motor M8 and a crank arm 55 pinned to the slide at 56 to reciprocate the slide between said first and second positions. The tube 53 is evacuated by a suitable suction pump and motor M9 (FIG. 1) and tube 57.

When in the full line position, tube 53 attracts the strip 51 to remove one strip from magazine 50, while upon removal of one strip, the next upper strip is held against movement by retard means such as a velcro-like strip 58, best seen in FIG. 8.

Upon movement of vacuum tube 53 to the broken line position and engagement of the ends of the strip with stops 59, the strip is released from the tube 53 and drops onto a right angular seat, as indicated by the arrows in FIG. 5, provided by the two part heater means 60.

The two part heater designated 60 in FIG. 5, includes a lower heater 61 extended horizontally at the lower end of receiver tray T1. As previously described, this lower heater provides part of the shelf member to support the lower edge of a set of sheets in tray T1 extending at an incline substantially aligned with tray T1. Also, the lower heater-shelf 61 has an end wall or back stop 63 against which the edges of the sheets are urged for engagement of the strip 51 between the sheet edge and wall 63.

The other heater part 64, as seen in FIGS. 5, 7, 8 and 8*a* is adapted to swing downwardly and ultimately in parallel relation to the lower heater element 61, for folding and finally clamping the binding strip 51 against the opposing outer sides of the edges of the set and, in conjunction with heater element 61, for thermally melting adhesive provided on the binding strip, as customary, and applying pressure for a suitable period to establish the bond following cooling.

To assure correct movement of the lowermost sheet of the set into proper seated engagement in the strip 51, a guide member 65 is pivotally mounted at 66 between the side walls 67 of a lower heater support 68. Guide 65 is slightly unbalanced so as to normally pivot in a clockwise direction, but upon engagement with an incoming sheet, to be automatically positioned in the full line position of FIG. 7.

Figure 11:
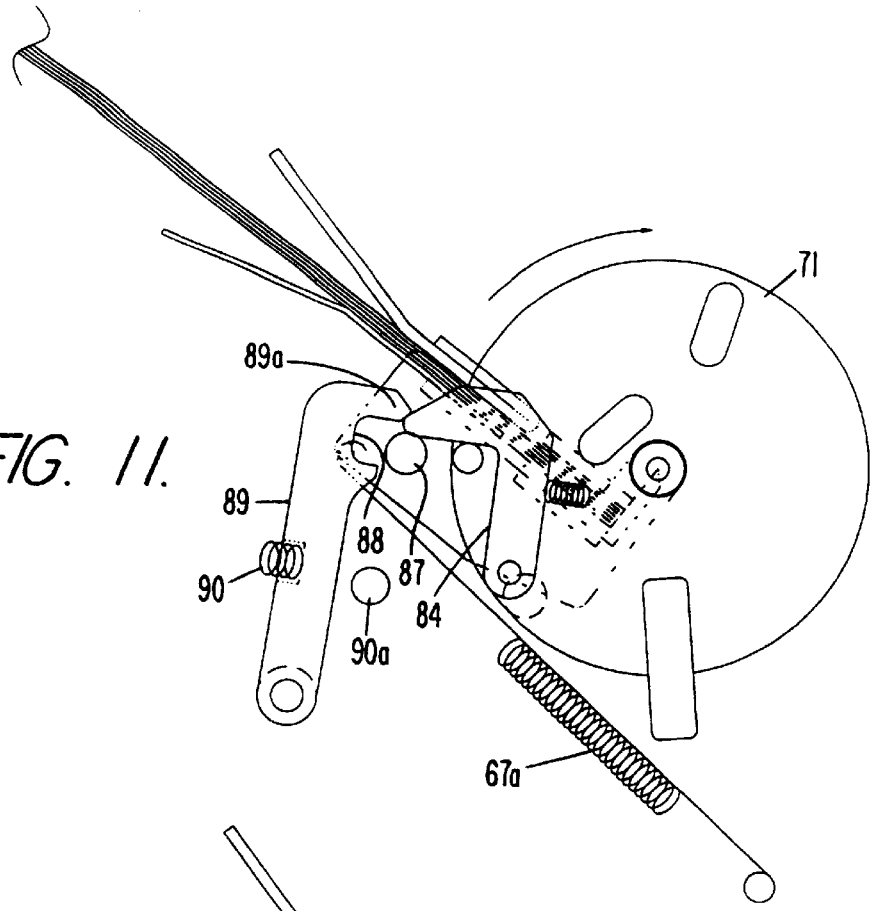
FIG. 11 shows partial reverse operation of the structure of FIG. 9 towards "HOME" and conditioning the components to drop the set.
Figure 12:
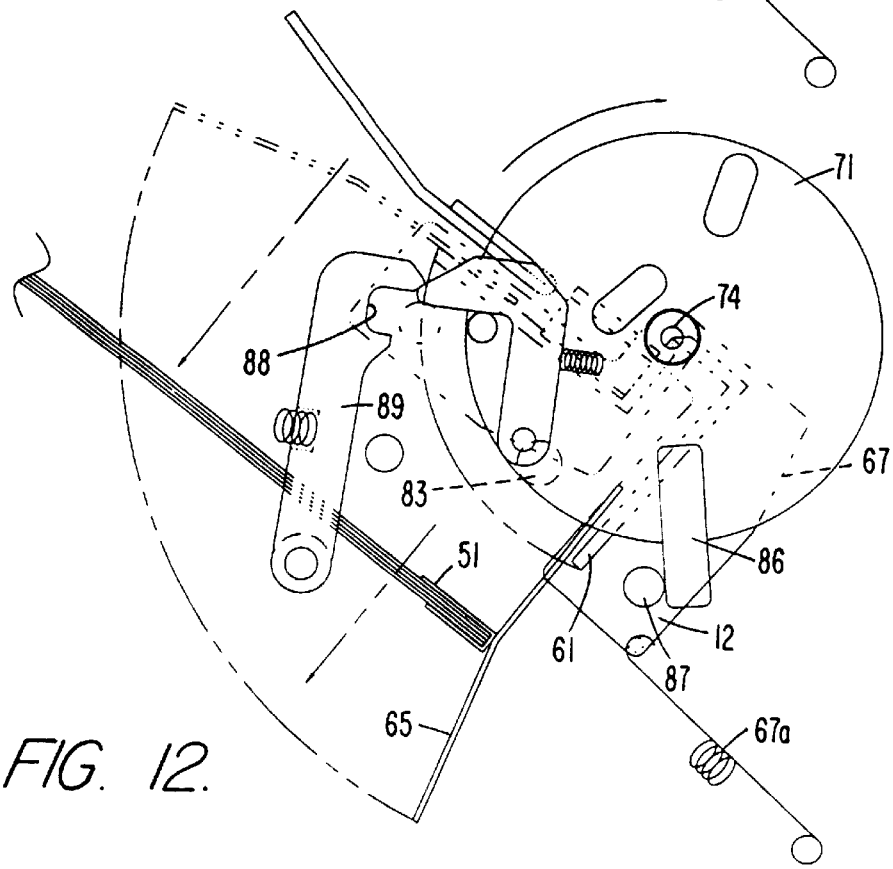
FIG. 12 shows the lower heater and sheet guide released to drop the bound set from the broken line position and, in the direction of the arrows, to the full line position.

As seen in FIGS. 11 and 12, the lower heater support 68 is adapted to swing downwardly from the position of FIG. 11 to the position of FIG. 12 so as to release the bound end of the set for downward movement following the binding operation.

However, during the binding operations, as will be seen by reference to FIGS. 7 through 11, means are provided for controlling the movement of the upper heater 64 and the downward swinging of the lower heater 61.

Figure 9:
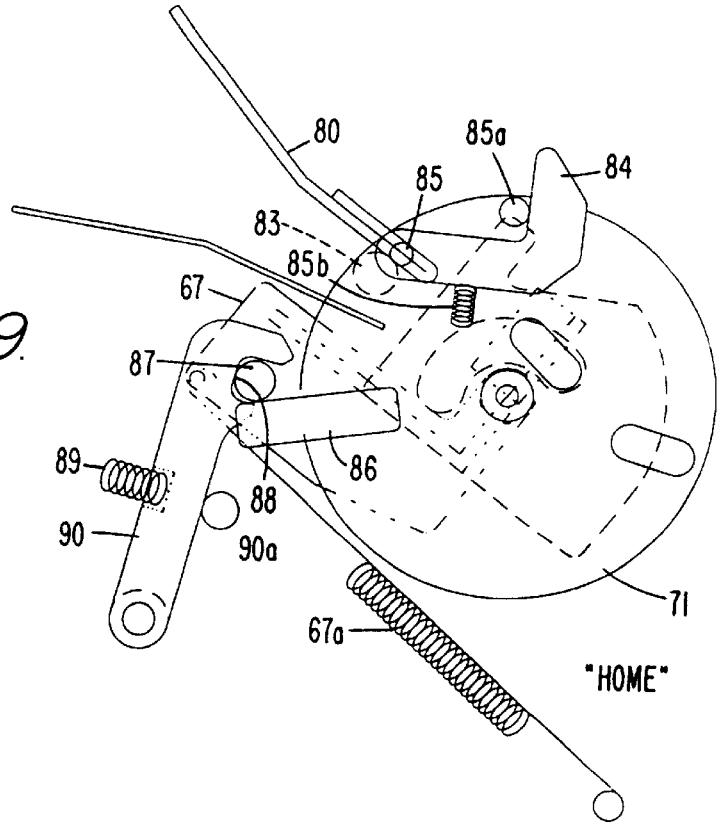
FIG. 9 is a detail view showing operating means for allowing and causing clamping of a sheet set in a binding strip supplied to the heater and in a normal "HOME" position of the operating means allowing the supply of sheets.

The means for operating and causing control of the operation of the two just mentioned movements of the upper heater into engagement with the set of sheets and the downward swinging movement of the lower heater to release the set from the binder, include a cam 70 best seen in FIGS. 8, 8*a* and 9 and a rotary member 71 which carries an upper heater support 72.

A fixed cam 70 and rotary member 71 are located at each of the respective opposite sides of the frame and are adapted to be driven by timed motor means M10 and gearing 73 between the motor M10 and the rotary member 71, so that, in timed relation, the respective rotary members 71 can be rotated relative to the fixed cam members 70 to not only cause or allow the above mentioned movements of the heater parts into bonding positions and release of the lower heater part from the binding position, but also, as will be later described, to allow movement of a pressure plate towards the lower heater in a relatively compound position tending to compact the edges of the sheets against the lower heater and the binding strip 51.

Figure 10:
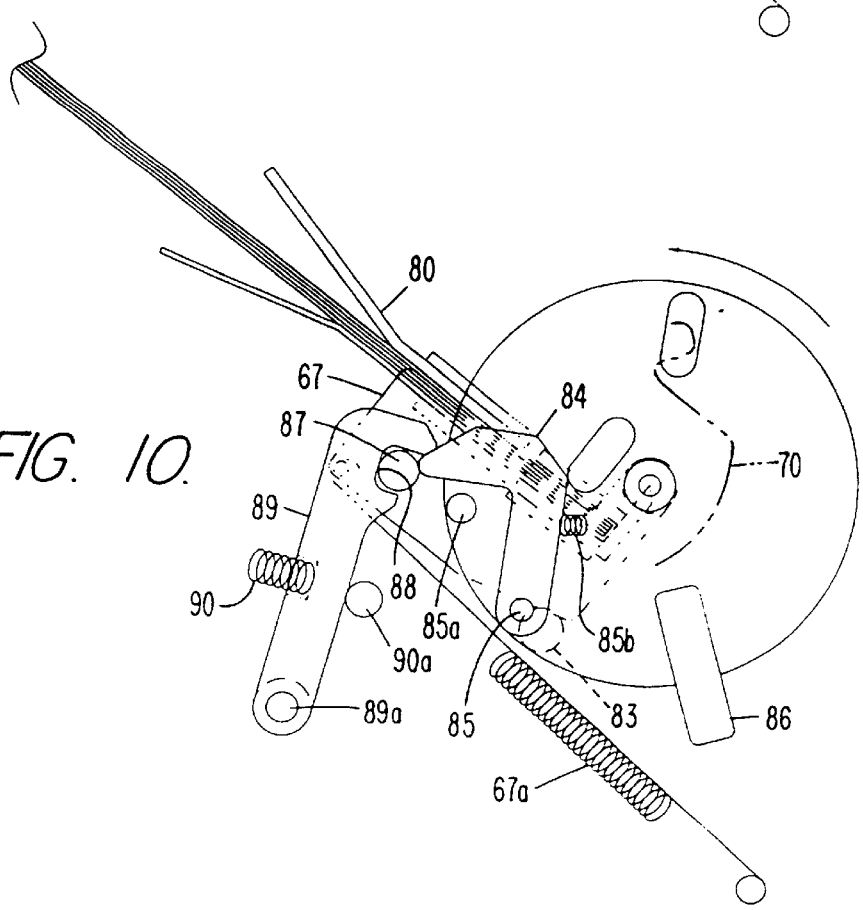
FIG. 10 shows the structure of FIG. 9 operated, as indicated by the arrow, to clamp the sheets in the heater.

The rotary member 71 is adapted to be rotated by the motor M10 from the "HOME" position shown in FIG. 9 in one direction as shown by the arrow in FIGS. 7 and 10 and in the return direction shown in FIGS. 11 and 12. The respective rotary member 71 revolves about a shaft 74 about which the upper heater support is free to rotate at each of its ends.

The heater support 72 carries, at its opposite ends, a first cam follower 75 and a second cam follower 76. As indicated in FIGS. 8 and 8*a*, the heater support 72, while being freely rotatable about the axis of shaft 74, is constrained by movement of follower 75 in an arcuate slot 75*a* of the fixed cam 70 and as rotation is caused by the engagement of the follower 75 in an elongated slot 75*b* in the rotary member 71 while the cam follower 76 is adapted to follow a face 76*a* on the fixed cam 70 due to rotation caused by engagement in a slot 76*b* in the rotary member, as it rotates in the direction of the arrow in FIG. 7. It will be noted at this point that face 76*a* of the cam 70 has an arcuate surface extended about the axis of rotation of the rotary member 71 and a tangentially extended surface 76*aa*, the geometry being such that as the rotary member 71 moves in a clockwise direction from the "HOME" position of FIG. 9 to the binding position of FIG. 10, the top heater 64 finally moves towards the lower heater 61 in a substantially parallel relationship, so as to clamp the sheets therebetween, thereby enabling a set of variable thickness to be formed.

As previously indicated, a pressure plate is provided and extends transversely of the apparatus to press the leading edge of the set of sheets into the binding strip 56. As seen specifically in full lines in FIG. 7, the pressure plate is designated 80 and is mounted for sliding downward movement on posts 81 at opposite ends of the apparatus under the influence of a coiled compression spring 82 at each end thereof.

On the respective disc or rotary member 71, there is a lug 83 projecting therefrom and engaged beneath the pressure plate 80 so as to maintain the same in an upper position when the rotary member 71 is in the "HOME" position of FIG. 9. However, upon rotation of the member 71 in the direction of the arrow seen in FIG. 7 away from the "HOME" position, this pin 83 will move downwardly from beneath the pressure plate 80 allowing it to be biased by spring 82 downwardly towards the top of the set of sheets in the binder in a compound relative motion to apply downward and endwise pressure thereto.

Also, as the rotary member 71 moves from the "HOME" position of FIG. 9 towards the position shown in FIG. 10, as indicated by the arrow, a pawl like member 84 pivoted at 85 and held by a pin 85*a* on the rotary member 71 and a reset pin 86 projecting radially from the rotary member 71, both move to the relative positions of FIG. 10 at which the pawl like member 84 has been urged by spring 85*b* to engage a pin 87 on lower heater support 67. This pin 87 is engaged in a seat 88 of a latch arm 89 pivoted at 89*a* and biased by spring 90 against a stop pin 90*a*.

Referring now to FIG. 11 it will be seen that on movement of the rotary member 71 in the direction of the arrow, the outer tip of the pawl member 84 engages a portion 89b of latch member 89, causing the latch 89 to swing against the force of spring 90, so that the pin 87 has been freed from the seat 88.

Thereafter, as seen in FIG. 12, upon release of the pin 87 from the seat 88, the lower heater seat 67 is urged by a tension spring 67*a* to swing downwardly about the pivot support 74 from the broken line position of FIG. 12 to the full line position allowing the set of sheets bound by the formed binding strip 51 to move downwardly from the lower heater support and lower heater 61 and from the guide 65 which, as previously described, is mounted upon the heater support 67, for movement downwardly to the stapling station S2.

It will be apparent that as the rotary member 71 continues to move in the direction of the arrow in FIG. 12 toward the "HOME" position of FIG. 9, the reset pin 86 will carry the latch pin 87 back to the position of FIG. 9, as the pawl 84 releases the latch 89 for return movement to the position latching the lower heater support 67 in its normal or "HOME" position. Also, the pin 83, on the rotary member 71, will return the pressure plate 80 to its upper position shown in FIG. 7 against the downward force of the spring 82.

Referring now to FIG. 13, it will be seen that a shelf 91 is of right angular shape and provides a lower wall 92 normally aligned to receive the lower edge of sheets received in tray T2, and a back wall 93 forms a backstop in which the lower edges can be aligned responsive to operation of the tamper arm 37 of FIG. 4.

A motor M11 and gearing are operable to swing the shelf about a horizontal pivot from the full line position of FIG. 13 to the broken line position, following stapling of the set and return of the stapled set to the "DROP" position and opening of the tray parts 30.

It should be understood that in the case that sets of sheets are being bound in station S1, the tray parts of station S2 may remain in the "DROP" position and the shelf may remain in the just mentioned broken line position, so that the bound sets can pass freely through the stapling station. Similarly sheets that are to be stapled into sets may be fed into the apparatus with the tray parts in station S1 in the "DROP" position and the heater shelf in the full line position of FIG. 12, so that the sheets may be individually allowed to pass downwardly to stapling station S2.

Further, it should be understood that the stations S1 and S2 may be inverted, which is to say that the stapling station may be situated above the binding station.

It should also be understood that it is within the purview of the invention that in a simple form of the apparatus in which binding and/or stapling are not necessarily desired in association with a particular host machine, the apparatus may be modular or modified so as to include only one of the stations S1 and S2 disposed above the stacker station S3, while retaining the advantages of a small footprint, as referred to hereinabove.

It will be recognized by those skilled in the art that control means (not shown) will be apparent for sequentially, as needed, controlling the operation of the respective motors M1 through M11 both as to the extent and sense of rotation.

Similarly, it will be recognized by those skilled in the art, that the respective heater elements in the thermal binding mechanism may be heated for preliminary and primary periods of heating for effectively causing thermo-plastic transformation of the adhesive material provided by the binding strip, followed by a suitable cooling period, as may be necessary.

Finally, it should be understood that the motions of the various mechanically operated heater elements and the releasing of the lower heater element have been hereinafter illustrated as being preferably operable by relatively few motor devices and that the binding means may be operated also by appropriate sequencing of solenoids or other actuating devices.

While a specific embodiment of the invention has been hereinafter illustrated and described, it should be understood that such illustration and description should not be taken in a limiting sense.

We claim:

1. A set finishing apparatus adapted for utilization with sheets fed from an image producing machine comprising:

a two part heater element having a first part, forming a right angular seat for a right angular binding strip, and a second part;

a magazine for receiving a stack of the binding strips;

a transport mechanism adapted to successively move one of the binding strips from the magazine to the right angular seat; a delivery mechanism adapted to deliver a set of sheets to the binding strip in the right angular seat with an edge of the set supported by the right angular seat with the binding strip therebetween;

an engagement mechanism adapted to move the second part of the heater element parallel pressure engagement with the set of sheets against a parallel portion of the first part; and the heater element being adapted to applying heat to the binding strip.

2. The apparatus of claim 1, further comprising:

wherein the right angular seat pivots downwardly for removal of bound sets.

3. The apparatus of claim 1 further comprising:

the second part of the heater element is initially in a position generally aligned with a first portion of the right angular seat to collectively receive a first portion of the right angular binding strip, while a second portion of the right angular binding strip is received by a second portion of the first part of the heater element; and the second part of the heater element being adapted to move into a position generally parallel to the second portion of the first part of the heater element, separated therefrom by the intervening set of sheets with the second portion of the right angular binding strip and a length of the first portion of the right angular binding strip on opposing sides of the set of sheets and in contact, respectively, with the first part of the heater element and the second part of the heater element.

4. The apparatus of claim 2 further comprising:

the second part of the heater element is initially in a position generally aligned with a first portion of the right angular seat to collectively receive a first portion of the right angular binding strip, while a second portion of the right angular binding strip is received by a second portion of the first part of the heater element; and the second part of the heater element being adapted to move into a position generally parallel to the second portion of the first part of the heater element, separated therefrom by the intervening set of sheets with the second portion of the right angular binding strip and a length of the first portion of the right angular binding strip on opposing sides of the set of sheets and in contact, respectively with the first part of the heater element and the second part of the heater element.

5. The apparatus of claim 3, further comprising:

the heater element including a heater assembly adapted to apply heat to each of the first and second parts of the heater element; and, the second part of the heater element adapted to move the length of the first portion of the right angular binding strip into engagement with the set of sheets and to apply pressure, in conjunction with the first part of the heater element to the intervening set of sheets and right angular binding strip.

6. The apparatus of claim 4, further comprising:

the heater element including a heater assembly adapted to apply heat to each of the first and second parts of the heater element; and, the second part of the heater element adapted to move the length of the first portion of the right angular binding strip into engagement with the set of sheets and to apply pressure, in conjunction with the first part of the heater element, to the intervening set of sheets and right angular binding strip.

7. A set finishing means for utilization with sheets fed from an image producing machine comprising:

a two part heater means for applying heat and pressure to a right angular binding strip, the two part heater means having a first part, forming a right angular seat for the right angular binding strip, and a second part moveable in relation to the first part;

a magazine for receiving a stack of the binding strips;

a transport means for successively moving one of the binding strips from the magazine to the right angular seat;

a delivery means for delivering a set of sheets to the binding strip in the right angular seat with an edge of the set supported by the right angular seat with the binding strip therebetween;

an engagement means for moving the second part of the heater element into parallel pressure engagement with the set of sheets against a parallel portion of the first part; and the heater means applying heat to the binding strip.

8. The apparatus of claim 7, further comprising:

wherein the right angular seat pivots downwardly for removal of bound sets.

9. The apparatus of claim 7 further comprising:

the second part of the heater means is initially in a position generally aligned with a first portion of the right angular seat to collectively receive a first portion of the right angular binding strip, while a second portion of the right angular binding strip is received by a second portion of the first part of the heater means; and the second part of the heater means having a means to move the second part of the heater means into a position generally parallel to the second portion of the first part of the heater means, separated therefrom by the intervening set of sheets with the second portion of the right angular binding strip and a length of the first portion of the right angular binding strip on opposing sides of the set of sheets and in contact, respectively, with the first part of the heater element and the second part of the heater element.

10. The apparatus of claim 8 further comprising:

the second part of the heater means is initially in a position generally aligned with a first portion of the right angular seat to collectively receive a first portion of the right angular binding strip, while a second portion of the right angular binding strip is received by a second portion of the first part of the heater means; and the second part of the heater means having a means to move the second part of the heater means into a position generally parallel to the second portion of the first part of the heater means, separated therefrom by the intervening set of sheets with the second portion of the right angular binding strip and a length of the first portion of the right angular binding strip on opposing sides of the set of sheets and in contact, respectively, with the first part of the heater element and the second part of the heater element.

11. The apparatus of claim 9, further comprising:

the heater means including a heater assembly means for applying heat to each of the first and second parts of the heater means; and, the second part of the heater means including means for moving the length of the first portion of the right angular binding strip into engagement with the set of sheets and for applying pressure, in conjunction with the first part of the heater means, to the intervening set of sheets and right angular binding strip.

12. The apparatus of claim 10, further comprising:

the heater means including a heater assembly means for applying heat to each of the first and second parts of the heater means; and, the second part of the heater means including means for moving the length of the first portion of the right angular binding strip into engagement with the set of sheets and for applying pressure, in conjunction with the first part of the heater means, to the intervening set of sheets and right angular binding strip.

13. A method for set finishing for utilization with sheets fed from an image producing machine comprising:

employing a two part heater element to apply heat and pressure to a right angular binding strip, the two part heater element having a first part, forming a right angular seat for the right angular binding strip, and a second part moveable in relation to the first part;

receiving a stack of the binding strips in a binding strip magazine;

successively moving one of the binding strips from the magazine to the right angular seat;

delivering a set of sheets to the binding strip in the right angular seat with an edge of the set supported by the right angular seat with the binding strip therebetween;

moving the second part of the heater element into parallel pressure engagement with the set of sheets against a parallel portion of the first part; and applying heat to the binding strip through the fist and second parts of the heater element.

14. The method of claim 13, further comprising:

pivoting the angular seat downwardly to remove the bound sets.

15. The method of claim 13 further comprising:

initially positioning the second part of the heater element in a position generally aligned with a first portion of the right angular seat to collectively receive a first portion of the right angular binding strip, while a second portion of the right angular binding strip is received by a second portion of the first part of the heater element; and moving the second part of the heater element into a position generally parallel to the second portion of the first part of the heater element, separated therefrom by the intervening set of sheets with the second portion of the right angular binding strip and a length of the first portion of the right angular binding strip on opposing sides of the set of sheets and in contact, respectively, with the first part of the heater element and the second part of the heater element.

16. The method of claim 14 further comprising:

initially positioning the second part of the heater element in a position generally aligned with a first portion of the right angular seat to collectively receive a first portion of the right angular binding strip, while a second portion of the right angular binding strip is received by a second portion of the first part of the heater element; and moving the second part of the heater element into a position generally parallel to the second portion of the first part of the heater element, separated therefrom by the intervening set of sheets with the second portion of the right angular binding strip and a length of the first portion of the right angular binding strip on opposing sides of the set of sheets and in contact, respectively, with the first part of the heater element and the second part of the heater element.

17. The method of claim 15, further comprising:

applying heat to each of the first and second parts of the heater element; and, utilizing the second part of the heater element to move the length of the first portion of the right angular binding strip into engagement with the set of sheets and to apply pressure, in conjunction with the first part of the heater element, to the intervening set of sheets and right angular binding strip.

18. The method of claim 16, further comprising:

applying heat to each of the first and second parts of the heater element; and, utilizing the second part of the heater element to move the length of the first portion of the right angular binding strip into engagement with the set of sheets and to apply pressure, in conjunction with the first part of the heater element, to the intervening set of sheets and right angular binding strip.

* * * * *